US007797856B2

(12) United States Patent
Andrews et al.

(10) Patent No.: US 7,797,856 B2
(45) Date of Patent: Sep. 21, 2010

(54) LIGHTWEIGHT SOLE FOR ARTICLE OF FOOTWEAR

(75) Inventors: Mike Andrews, Canton, MA (US); Paul Litchfield, Canton, MA (US); Jorgen Romer, Canton, MA (US); Ricardo Vestuti, Canton, MA (US)

(73) Assignee: Reebok International Ltd., Canton, MA (US)

( * ) Notice: Subject to any disclaimer, the term of this patent is extended or adjusted under 35 U.S.C. 154(b) by 817 days.

(21) Appl. No.: 11/733,676

(22) Filed: Apr. 10, 2007

(65) Prior Publication Data

US 2008/0250673 A1 Oct. 16, 2008

(51) Int. Cl.
*A43B 13/18* (2006.01)

(52) U.S. Cl. ..... 36/30 R; 36/25 R; 36/29

(58) Field of Classification Search ..... 36/3 R, 36/3 B, 29, 25 R, 30 R
See application file for complete search history.

(56) References Cited

U.S. PATENT DOCUMENTS 4,223,456 A 9/1980 Cohen
5,044,096 A * 9/1991 Polegato ..... 36/3 R
5,353,526 A 10/1994 Foley et al.
5,367,791 A * 11/1994 Gross et al. ..... 36/31
5,595,003 A * 1/1997 Snow ..... 36/28
5,915,819 A 6/1999 Gooding
5,937,544 A * 8/1999 Russell ..... 36/28
6,009,637 A * 1/2000 Pavone ..... 36/29
6,065,229 A 5/2000 Wahrheit
6,178,662 B1 1/2001 Legatzke
6,266,896 B1 7/2001 Liu
6,327,795 B1 * 12/2001 Russell ..... 36/28
6,330,757 B1 * 12/2001 Russell ..... 36/28
6,389,711 B1 * 5/2002 Polegato ..... 36/3 R
6,665,961 B2 12/2003 Kobayashi et al.
6,681,501 B1 1/2004 Polifroni
6,823,609 B2 * 11/2004 Moretti ..... 36/30 R
6,839,984 B2 * 1/2005 Polegato ..... 36/3 B (Continued)

FOREIGN PATENT DOCUMENTS

DE 10 2006 025 990 A1 12/2006

OTHER PUBLICATIONS

International Search Report, Application No. PCT/US2008/004582, dated Jul. 14, 2008, 4 pages.

(Continued)

*Primary Examiner*—Marie Patterson
(74) *Attorney, Agent, or Firm*—Sterne, Kessler, Goldstein & Fox P.L.L.C.

(57) ABSTRACT

A sole for an article of footwear comprising a midsole having a plurality of polygonal-shaped openings, or cavities, therein. In alternative embodiments, the sole includes reinforcement elements such as a plate disposed along at least a portion of one of the surfaces of the midsole. The plate includes at least one polygonal-shaped extension adapted to fit within at least a portion of at least one of the polygonal-shaped openings within the midsole. Additionally, a polyurethane film is disposed on at least a portion of the bottom surface of the midsole. The shoe also includes an outsole disposed on at least a portion of a bottom surface of the polyurethane film, wherein the outsole comprises a plurality of polygonal-shaped openings aligned with the polygonal-shaped openings of the midsole.

20 Claims, 11 Drawing Sheets

U.S. PATENT DOCUMENTS

| | | | | |
|---|---|---|---|---|
| 7,475,497 | B2 * | 1/2009 | Hoffer et al. | 36/28 |
| 7,523,566 | B2 * | 4/2009 | Young-Chul | 36/30 R |
| 7,559,157 | B2 * | 7/2009 | Polegato Moretti | 36/3 B |
| 2002/0157280 | A1 * | 10/2002 | Russell | 36/28 |
| 2004/0123493 | A1 * | 7/2004 | Russell | 36/28 |
| 2005/0172513 | A1 * | 8/2005 | Lechhart et al. | 36/3 B |
| 2005/0241082 | A1 * | 11/2005 | Moretti | 12/142 V |
| 2006/0096124 | A1 | 5/2006 | Moseley | |
| 2008/0216360 | A1 * | 9/2008 | Schenone | 36/30 R |

OTHER PUBLICATIONS

Written Opinion of the International Searching Authority, Application No. PCT/US2008/004582, dated Jul. 14, 2008, 6 pages.

* cited by examiner

LIGHTWEIGHT SOLE FOR ARTICLE OF FOOTWEAR

BACKGROUND OF THE INVENTION

1. Field of the Invention

The present invention relates to athletic footwear, and more specifically to an improved sole for an athletic shoe.

2. Background Art

It is important that footwear be comfortable while providing adequate support during various foot movements associated with a wearer's activity. Athletic footwear typically includes an upper and a sole. The sole is typically comprised of an Ethylene Vinyl Acetate (EVA) midsole and a rubber outsole. The bulk of the weight of athletic footwear is typically in the EVA midsole. It is an increasing objective of athletic footwear design to provide adequate support while reducing the weight of the shoe.

BRIEF SUMMARY OF THE INVENTION

Presented herein is a sole for an article of footwear comprising a midsole having a plurality of polygonal-shaped openings extending therethrough, and a plate disposed adjacent to at least a portion of the midsole. The plate includes at least one polygonal-shaped extension adapted to fit within at least a portion of at least one of said polygonal-shaped openings within said midsole. The plate may be formed of a thermoplastic material. In one embodiment, the sole further comprises an outsole disposed below the midsole, wherein the outsole includes a plurality of polygonal-shaped openings extending therethrough and aligned with the polygonal-shaped openings of the midsole. Also the sole may further comprise a polyurethane film disposed between the midsole and the outsole.

In alternative embodiments, the polyurethane film may be transparent, translucent, or opaque. The polyurethane film may further include a lip portion extending partially into at least one of the plurality of polygonal-shaped openings in the midsole. Further, the polygonal-shaped openings may be any shape, including a hexagonal shape.

In accordance with another embodiment of the present invention, there is provided a sole for an article of footwear comprising a midsole having a plurality of polygonal-shaped openings extending therethrough, a medial plate disposed along at least a portion of the medial side of the midsole, and a lateral plate disposed along at least a portion of the lateral side of the midsole. The medial plate includes at least one polygonal-shaped extension adapted to fit within at least a portion of at least one of the polygonal-shaped openings in the medial side of the midsole. The lateral plate includes at least one polygonal-shaped extension adapted to fit within at least a portion of at least one of the polygonal-shaped openings on the lateral side of the midsole. In one embodiment, the lateral plate has a softer durometer than the medial plate. In one embodiment, the sole further comprises a transparent polyurethane film disposed below the midsole. The sole may further comprise an outsole disposed on a bottom surface of the polyurethane film. The outsole may include a plurality of polygonal-shaped openings extending therethrough and aligned with the polygonal-shaped openings of the midsole. The polyurethane film may be overmolded on a top surface of the outsole.

In accordance with another embodiment of the present invention, there is provided a sole for an article of footwear comprising a midsole having a plurality of polygonal-shaped cavities formed therein, a polyurethane film disposed on a bottom surface of the midsole to thereby form a plurality of fluid filled compartments in the midsole, and an outsole disposed below the polyurethane film. The outsole includes a plurality of polygonal-shaped openings extending therethrough and aligned with respective ones of the plurality of polygonal-shaped cavities formed in the midsole. The polyurethane film may be transparent. The polyurethane film may further include a lip portion extending partially into at least one of the plurality of polygonal-shaped cavities formed in the midsole. The polygonal-shaped cavities may be any shape, including a hexagonal shape. The polygonal-shaped cavities may extend only a portion of the way into the midsole. For example, the cavities may extend at least one-quarter or at least one-half of the way into the midsole.

BRIEF DESCRIPTION OF THE DRAWINGS/FIGURES

The accompanying figures, which are incorporated herein and form part of the specification, illustrate an athletic shoe. Together with the description, the figures further serve to explain the principles of the athletic shoe described herein and thereby enable a person skilled in the pertinent art to make and use the athletic shoe.

DETAILED DESCRIPTION OF THE INVENTION

Presented herein are various embodiments of an article of footwear having polygonal-shaped openings, or cavities, in the midsole of the shoe. The embodiments described herein disclose various alternatives to the general concept of creating a lightweight article of footwear by removing portions of the midsole. The embodiments described also disclose various methods of reinforcing the footwear such that the stability of the shoe is not compromised by the removal of portions of the midsole. While the various embodiments are described with respect to an athletic shoe, it would be within the purview of one of skill in the art to apply the teachings disclosed in any type of footwear; for example, sandals, dress shoes, boots, etc. The appended claims should not be limited to the specific structures described herein.

Preferred embodiments of an athletic shoe are described below with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the appended claims.

Figure 1:
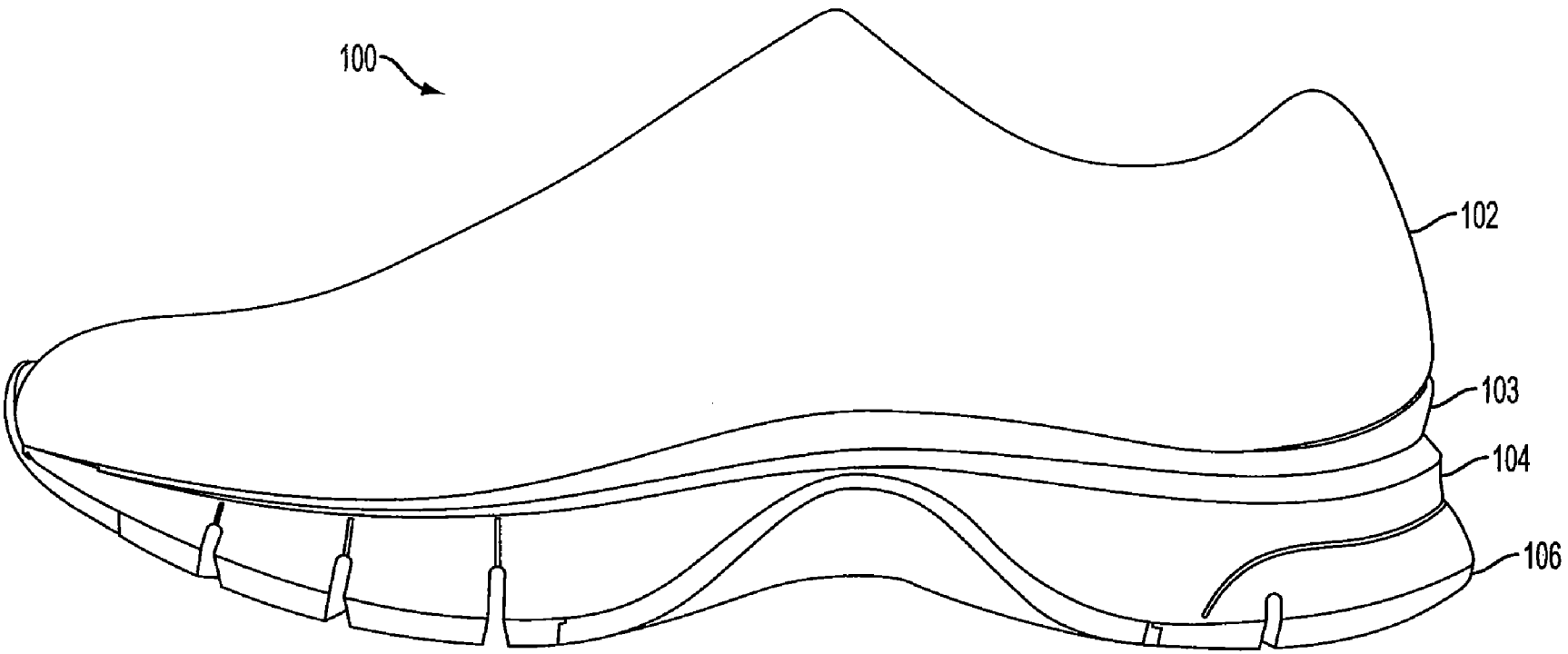
FIG. 1 is a side view of an athletic shoe in accordance with one embodiment of the present invention.

FIG. 1 is a side view of an athletic shoe 100 in accordance with one embodiment of the present invention. While the present invention is described with relation to an athletic shoe, it would be within the purview of one of skill in the art to incorporate the present invention into any article of footwear, including, for example, boots, sandals, dress shoes, etc. A shoe for a left foot according to an embodiment of the present invention is shown generally at 100 in FIG. 1. A corresponding shoe for the right foot is generally a mirror image of shoe 100 and therefore, is not shown or described herein.

Shoe 100 is comprised of an upper 102, a plate 103, a midsole 104, and an outsole 106. Plate 103 is disposed below upper 102. Disposed below plate 103, is midsole 104. Disposed below midsole 104, is outsole 106. Disposed between midsole 104 and outsole 106 is a film, which is not shown but will be discussed with relation to FIG. 2.

Upper 102 may be made of any suitable material, as for example, a cloth material, a mesh material, or a leather material. Upper 102 may be of any design, shape, or material deemed fit by one of ordinary skill in the art. Plate 103, is preferably formed of an enhanced plastic material, including, but not limited to, thermoplastic polyurethane (TPU) and other thermoplastic elastomers, such as that available from Arkema, Inc., of Philadelphia, Pa., under the Pebax™ trade name or that available from Degussa GmbH, of Dusseldorf, Germany, under the Vestamid™ trade name. Midsole 104 is preferably formed of an EVA material, although alternative materials may be deemed appropriate as would be apparent to one of ordinary skill in the art. Outsole 106 is preferably a rubber material, although alternative materials may be deemed appropriate as would be apparent to one of ordinary skill in the art.

Figure 2:
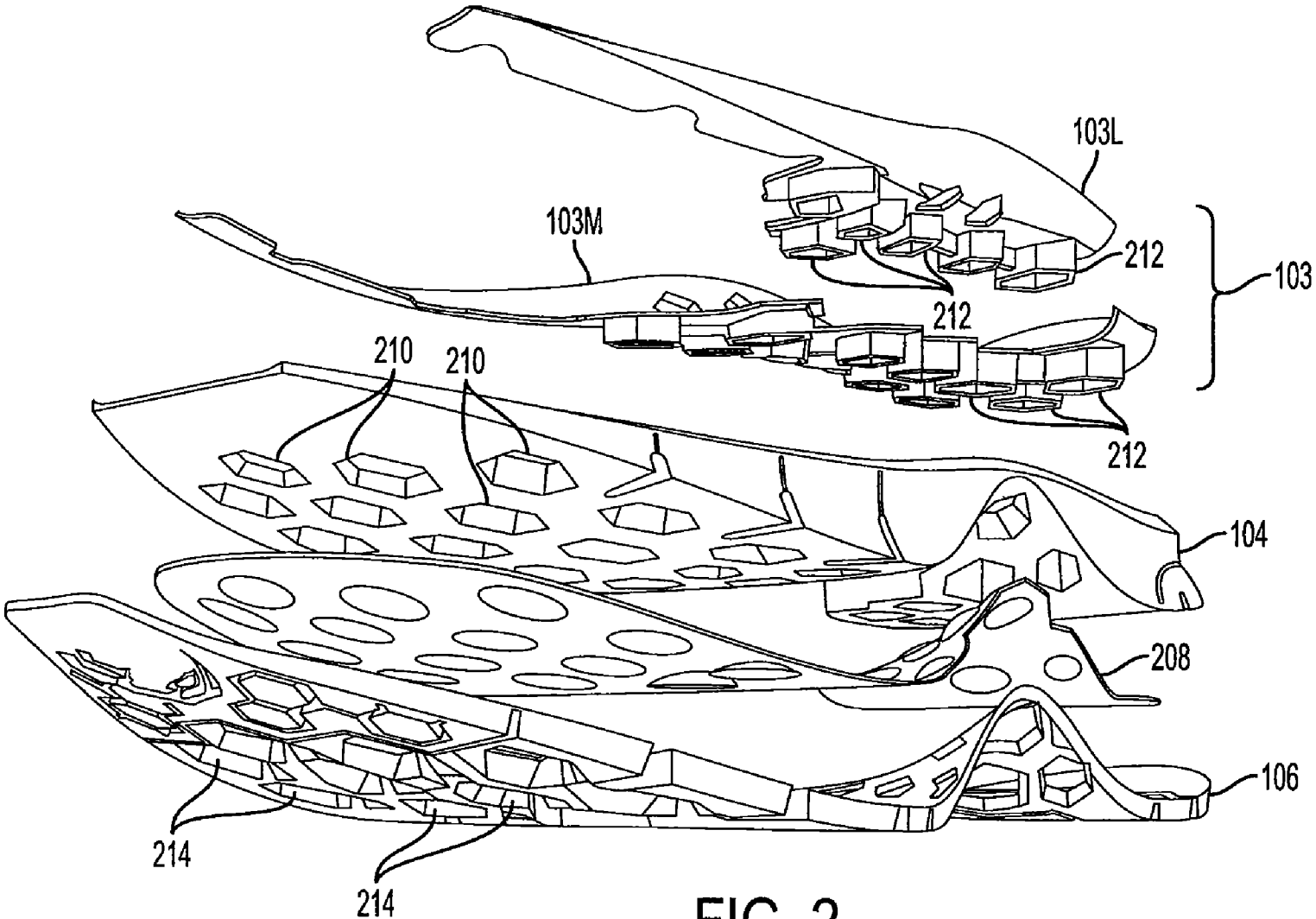
FIG. 2 is an exploded perspective view of a sole of an athletic shoe in accordance with one embodiment of the present invention.

FIG. 2 is an exploded view of a sole of an athletic shoe in accordance with one embodiment of the present invention. The sole is comprised of plate 103, midsole 104, a film 208, and outsole 106. In the embodiment shown in FIG. 2, plate 103 is formed of two pieces, a lateral plate 103L and a medial plate 103M. In an alternative embodiment, plate 103 may be formed of one integral piece. Midsole 104 is preferably formed of one integral piece, but may also be formed of multiple components. Likewise, outsole 106 may be formed of one integral piece, as shown, or a plurality of segmented components.

Midsole 104 includes a plurality of polygonal-shaped openings 210 extending therethrough from a top surface to a bottom surface of midsole 104. As used herein, the term "polygonal-shaped" is intended to refer to any shape, which therefore includes triangles, squares, circles, ovals, or odd shaped openings or cavities. In an alternative embodiment, as discussed below, openings 210 may extend through only a portion of midsole 104. Such openings 210 may be formed by creating a unitary midsole 104 and then cutting or punching out the polygonal-shaped openings 210. Alternatively, openings 210 may be formed by a mold technique, including, but not limited to, injection molding. By creating such openings 210, a substantial amount of the weight of midsole 104 is removed. Preferably, openings 210 are spaced apart along midsole 104, creating areas of solid midsole between openings 210.

The design of shoe 100 provides that pieces of midsole 104 may be removed, thus reducing the weight of the overall shoe, while not sacrificing the structural integrity of the shoe. To avoid compromising the structural integrity of shoe 100, plate 103 includes a plurality of polygonal-shaped extensions 212 adapted to be aligned with and fit within corresponding polygonal-shaped openings 210 within midsole 104. Extensions 212 may be hollow (as shown), or may be solid. Where extensions 212 are hollow, a corresponding hole may be formed through plate 103 having a diameter approximately equal to the inner diameter of extension 212. Alternatively, plate 103 may extend across the openings of hollow extensions 212 so as to create a wall perpendicular to extensions 212. For example, in one embodiment, extensions 212 are hollow, having a thin wall which abuts against an inner perimeter of openings 210 of midsole 104, and plate 103 extends across the upper openings of extensions 212 such that plate 103 is visible from the open end of extensions 212. In alternative embodiments, plate 103 may be disposed on a top surface or a bottom surface of midsole 104, such that extensions 212 fit within at least a portion of openings 210 of midsole 104. For example, extensions 212 may fit within ¼, ½, ¾ or the entire height of openings 210 of midsole 104. As such, extensions 212 act to reinforce midsole 104. Extensions 212 are spaced apart along a surface of plate 103 such that the spaces between extension 212 rest on the solid surface of midsole 104 between openings 210.

Disposed along at least a portion of the bottom surface of midsole 104 is a film 208. Film 208 is a thin sheet of material, preferably a thin sheet of a transparent, polyurethane material. In alternative embodiments, film 208 may be translucent or opaque. As such, when appropriately aligned, film 208 adds to the structural integrity of shoe 100. Film 208 also allows for visualization of the internal components of the sole of shoe 100. For example, film 208 allows for the visualization of plate 103 and/or the inner surface of openings 210 in midsole 104. In one embodiment, plate 103 is disposed on a top surface of midsole 104 and film 208 is disposed on a bottom surface of midsole 104, such that compartments are formed between plate 103 and film 208 in openings 210 of midsole 104. A fluid, such as pressurized or unpressurized (ambient) air, may be trapped within openings 210, between plate 103 and film 208. In one embodiment, film 208 may include concave portions which project into openings 210 within midsole 104. Alternatively, film 208 may include convex portions which project away from openings 210 within midsole 104.

Disposed along at least a portion of a bottom surface of film 208 is outsole 106. Outsole 106 may include a plurality of polygonal-shaped openings 214. Polygonal-shaped openings 214 of outsole 106 are designed to align with polygonal-shaped openings 210 of midsole 104 and provide visualization of openings 210 from the bottom of shoe 100. In one embodiment, outsole 106 is one integral piece. In an alternative embodiment, outsole 106 is comprised of a plurality of outsole components disposed below film 208. In one embodiment, film 208 is overmolded onto a surface of outsole 214. In an alternative embodiment, if film 208 is not used, outsole 106 may be disposed along at least a portion of a bottom surface of midsole 104.

Lateral plate 103L is preferably formed of an enhanced plastic material. Medial plate 103M is also preferably formed of an enhanced plastic material. In one embodiment, lateral plate 103L is formed of a material having a softer durometer than that of medial plate 103M, i.e. a material having a lesser degree of hardness than medial plate 103M. As such, the purpose of separating lateral plate 103L from medial plate 103M is to provide the look and feel of one contiguous plate, but at a softer durometer than the medial plate, to thereby accommodate for a broad range of foot support requirements. In an alternative embodiment, plate 103 is formed of one contiguous piece.

Figure 3:
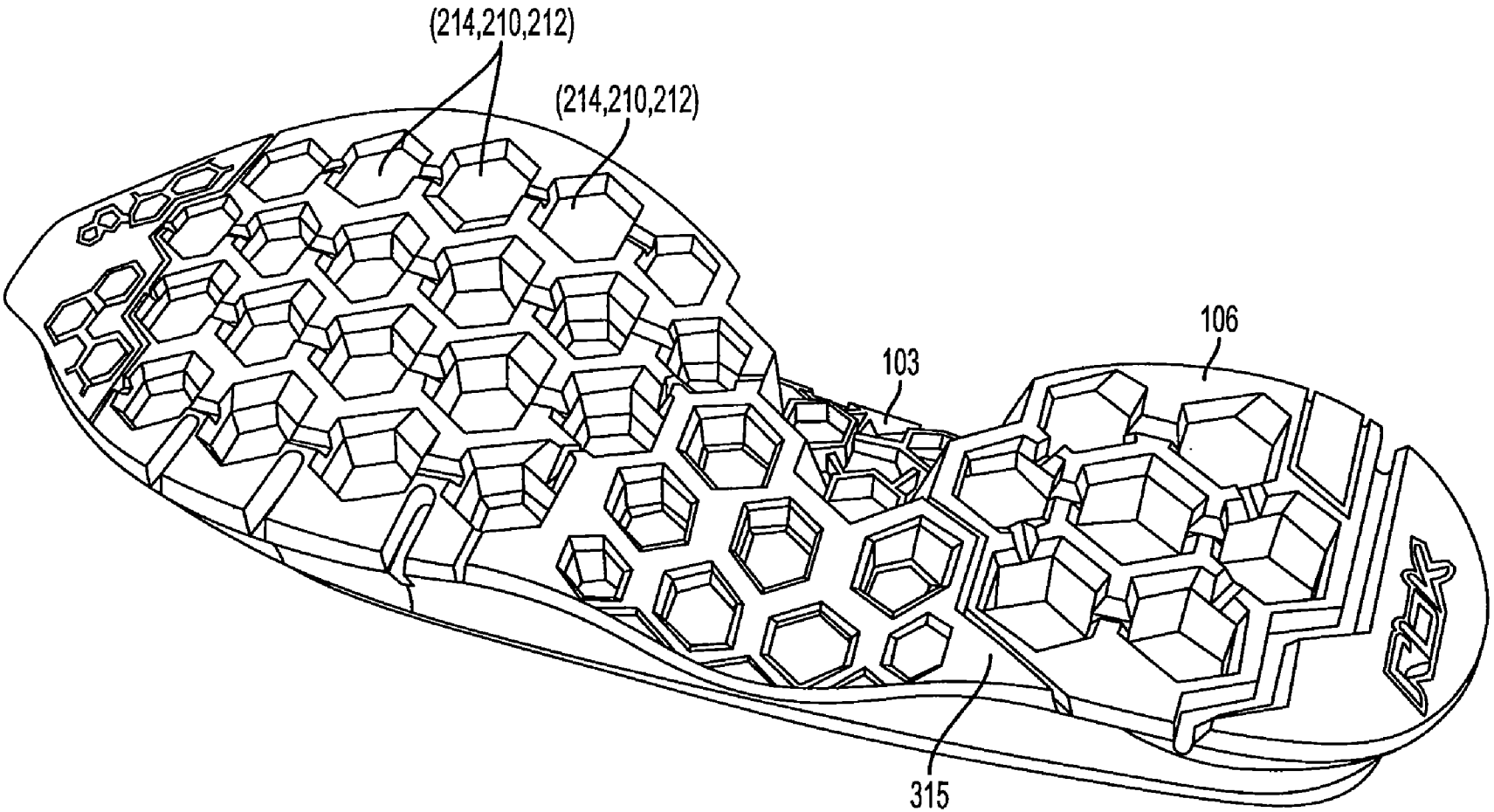
FIG. 3 is a bottom perspective view of the athletic shoe of FIG. 1.
Figure 4A:
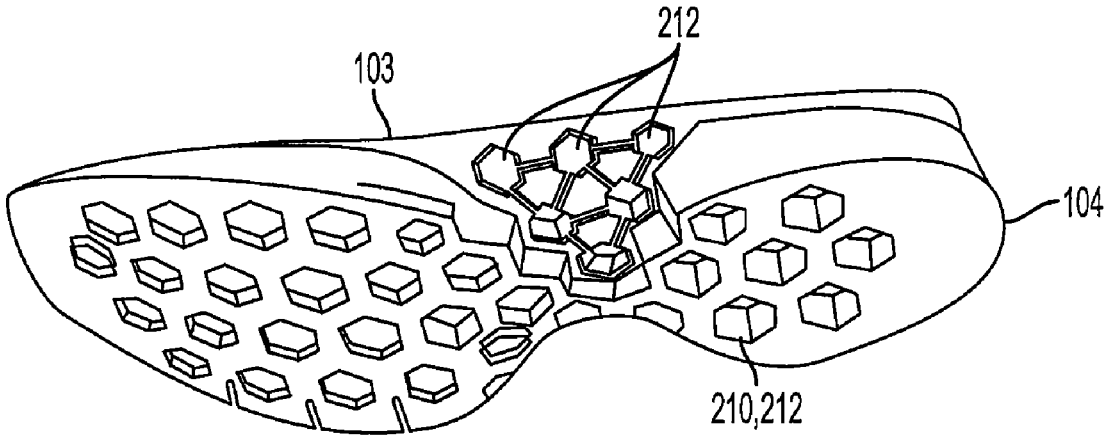
FIG. 4A is a bottom perspective view of a sole of an athletic shoe in accordance with an alternative embodiment of the present invention.

FIG. 3 is a bottom view of shoe 100. As evident from FIG. 3, the plurality of polygonal-shaped openings 214 in outsole 106, and the plurality of polygonal-shaped openings 210 in midsole 104, provide small viewing windows into the sole of shoe 100. These viewing windows add to the aesthetic design of shoe 100. The polygonal-shaped openings (210, 214) may be hexagonal, as shown, or any other shape as would be apparent to one or ordinary skill in the art. As shown in FIG. 3, outsole 106 may be comprised of a plurality of pieces, leaving a portion of lower surface 315 of midsole 104 exposed. As shown in FIGS. 3 and 4A, a portion of plate 103 may be visible from the bottom and/or one or more sides of shoe 100.

Figure 4B:
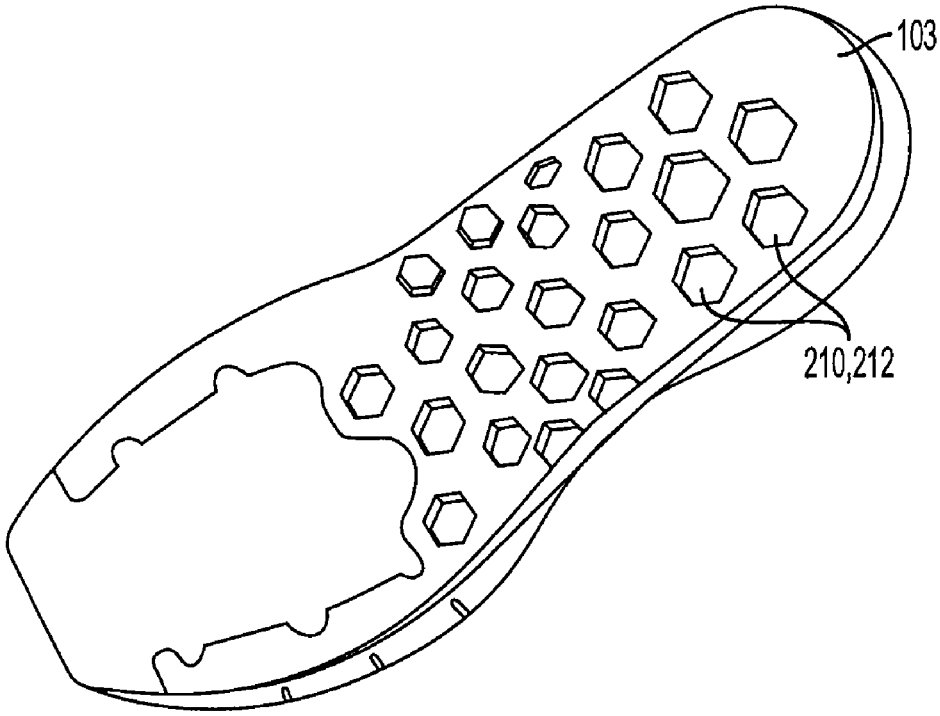
FIG. 4B is a top perspective view of a sole of an athletic shoe in accordance with an alternative embodiment of the present invention.

FIGS. 4A and 4B are bottom and top views, respectively, of components of the sole of shoe 100, in accordance with an alternative embodiment of the present invention. FIG. 4A is a bottom view of midsole 104. As evident from FIG. 4A, a plurality of polygonal-shaped openings 210 are provided to extend through midsole 104 from a top surface to a bottom surface of midsole 104. These plurality of openings 210 are supported by the extensions 212 on plate 103. FIG. 4B is a top view of midsole 104 and plate 103. As evident from FIG. 4B, the plurality of extensions 212 on plate 103 are aligned with and fit within the plurality of openings 210 of midsole 104. Also shown in FIG. 4B is an embodiment wherein plate 103 is formed of one integral piece. While plate 103 is shown in FIG. 4B as extending from the heel to the arch area of midsole 104, and only along portions of the forefoot area of midsole 104, it will be apparent to one of ordinary skill in the art that other arrangements for plate 103 may be used. For example, plate 103 may be a heel only plate, a forefoot only plate, or a plate which extends along all of midsole 104.

Figure 5A:
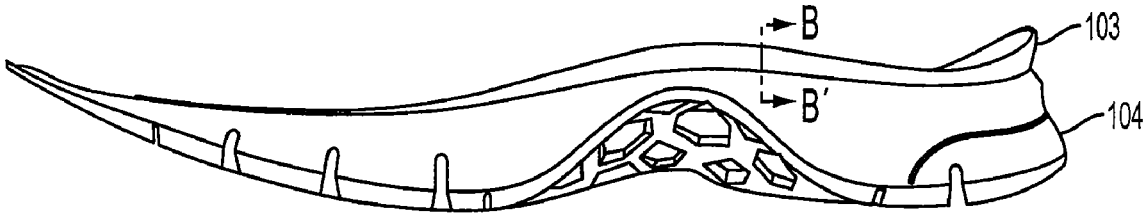
FIG. 5A is a side view of a sole of an athletic shoe in accordance with one embodiment of the present invention.
Figure 5B:
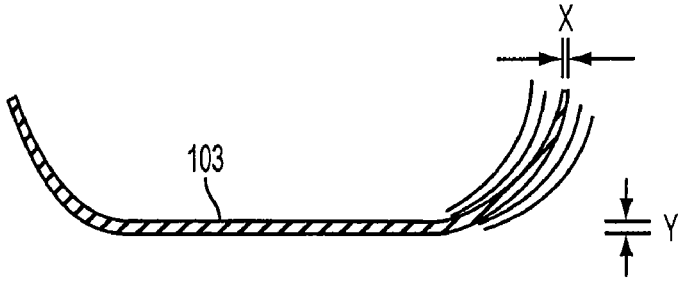
FIG. 5B is a cross-section view taken along line B-B' of FIG. 5A.

FIG. 5A is a side view of the sole of shoe 100, in accordance with one embodiment of the present invention. As shown in FIG. 5A, a portion of extensions 212 and plate 103 may be exposed in the lateral arch area of shoe 100. FIG. 5B is a cross-section view taken along line B-B' of FIG. 5A. As evident from FIG. 5B, plate 103 has a side wall with a width X that is thinner than the width Y of the midsection of plate 103. This provides for added flexibility (as shown by the flexure lines in FIG. 5B) along the sidewalls of plate 103. Preferably, width X is about 0.7 mm, and width Y is about 11.0 mm.

Figure 6:
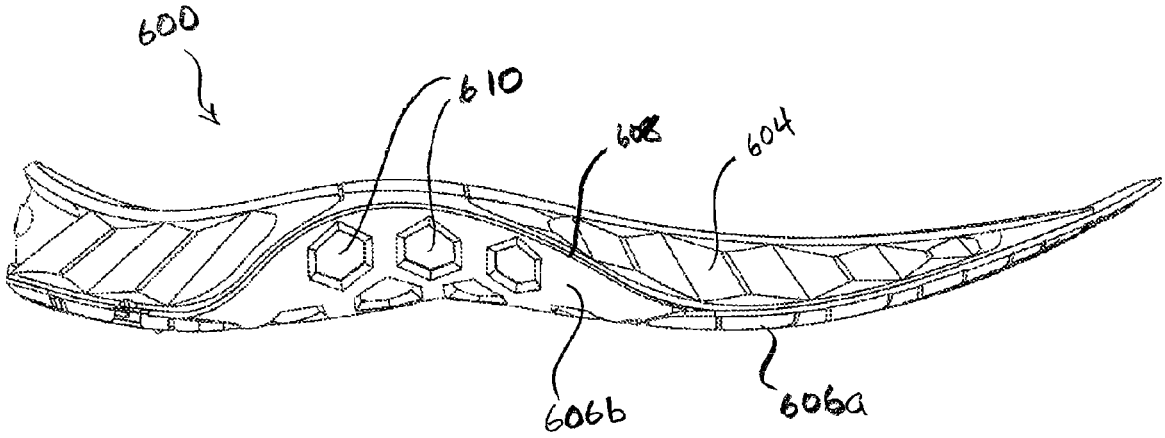
FIG. 6 is a side view of a sole in accordance with an alternative embodiment of the present invention.

FIG. 6 is a side view of a sole 600 in accordance with an alternative embodiment of the present invention. Sole 600 differs from the previously described soles in that sole 600 does not include a plate 103. Further, polygonal-shaped openings 610 do not transect entirely through midsole 604. In other words, sole 600 includes a midsole 604, a transparent film 608, and a segmented outsole 606*a*, 606*b*. Midsole 604 includes a plurality of openings 610, which form polygonal-shaped cavities of midsole 604. As such, openings 610 remove weight from midsole 604 without compromising the stability of sole 600. For example, openings 610 may extend through at least ¼, ½, or ¾ of the way through the midsole 604. As such, a substantial amount of the thickness of the midsole 604 remains intact and is not affected by the material removed.

Figure 7:
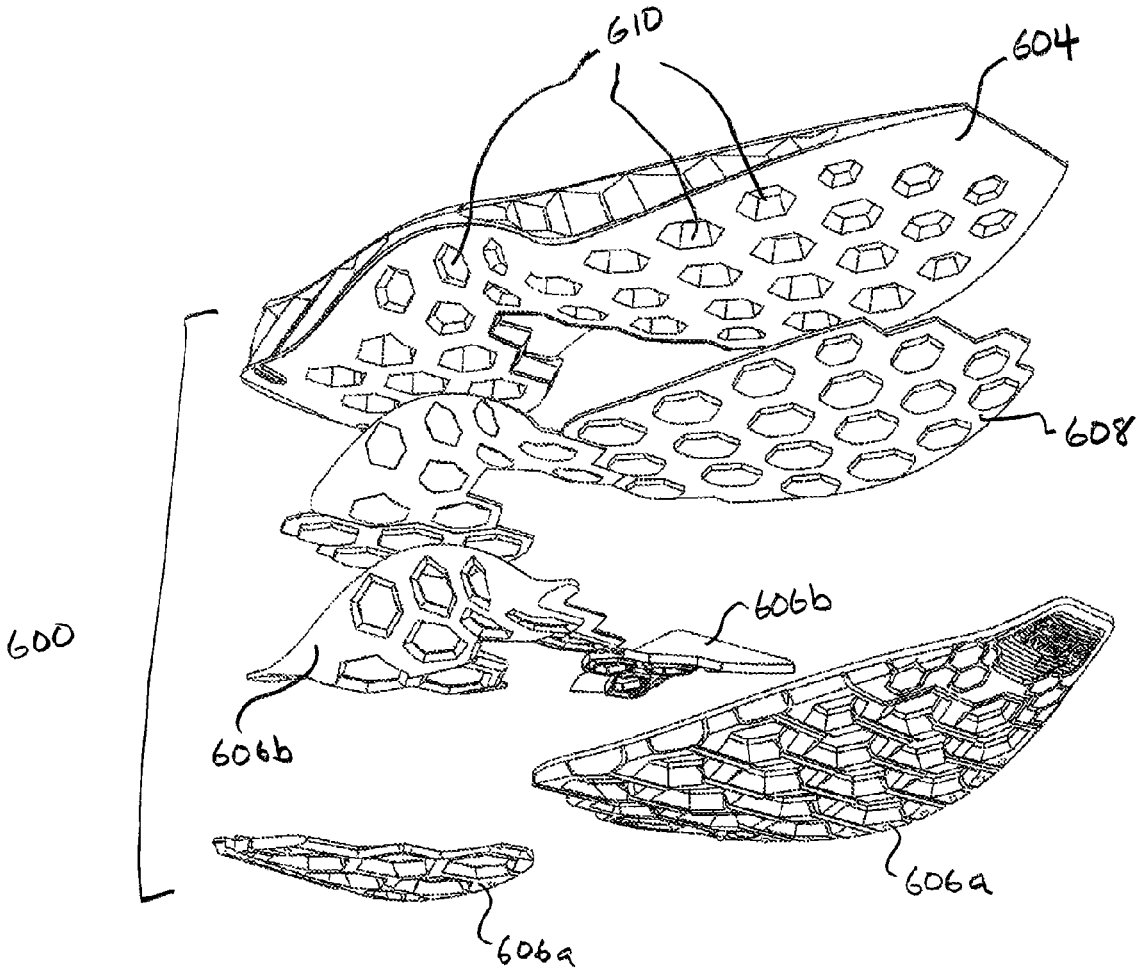
FIG. 7 is an exploded perspective view of the sole of FIG. 6.

FIG. 7 is an exploded perspective view of the sole 600 of FIG. 6. As can be seen from FIG. 7, midsole 604 includes a plurality of polygonal-shaped openings, or cavities, 610. A film 608, similar to the films discussed above, is disposed below midsole 604. Preferably, film 608 is a transparent film having polygonal-shaped viewing windows which align with openings 610 on midsole 604. In alternative embodiments, film 608 may be translucent or opaque. Disposed below film 608 is a segmented outsole 606*a*, 606*b*. In one embodiment, the segmented outsole is formed of rubber segments 606*a* and plastic segments 606*b*. As such, rubber segments 606*a* provide a durable contact surface while plastic segments 606*b* provide added support to sole 600. Alternatively, segments 606*a* and 606*b* may be formed of any material deemed fit by one of ordinary skill in the art. For example, segments 606*b* may be formed of rubber instead of a plastic material. Alternatively, each segment 606*b* may be formed of a different material. For example, one segment may be formed of plastic while the other segment is formed of rubber. Alternatively, sole 600 may include only one segment 606*b* in the arch area of sole 600.

Figure 8A:
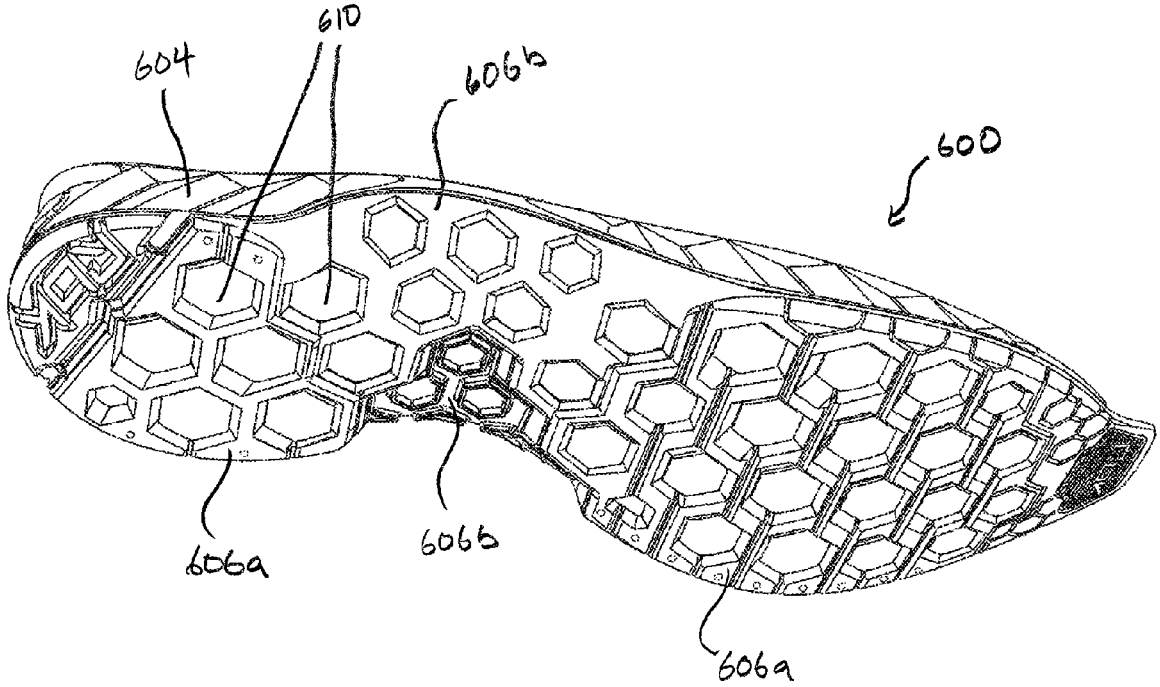
FIG. 8A is a bottom perspective lateral side view of the sole of FIG. 6.
Figure 8B:
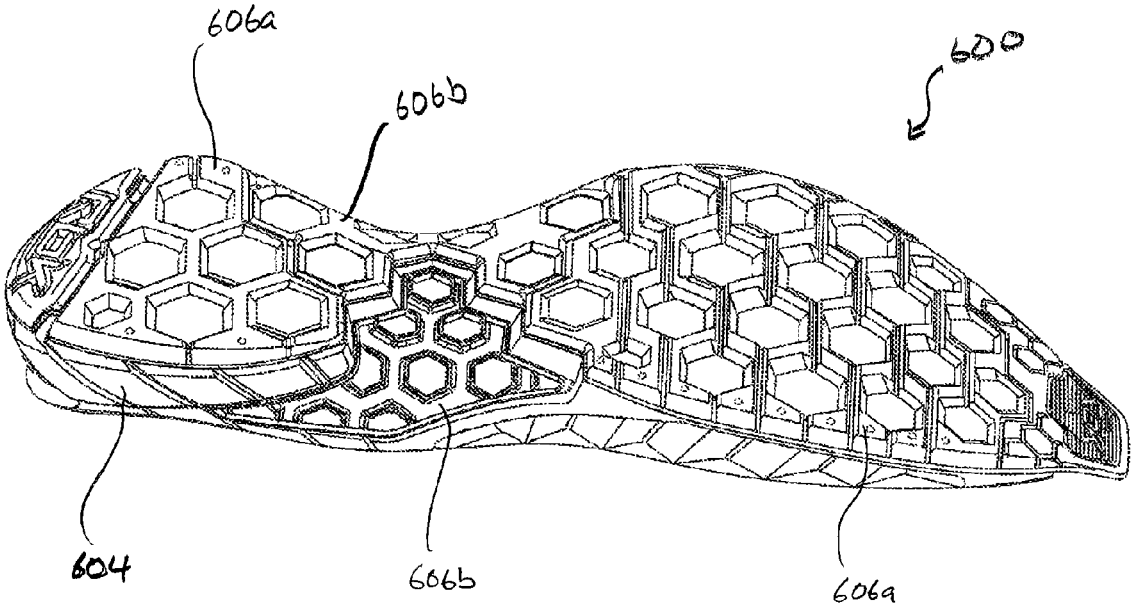
FIG. 8B is a bottom perspective medial side view of the sole of FIG. 6.
Figure 9:
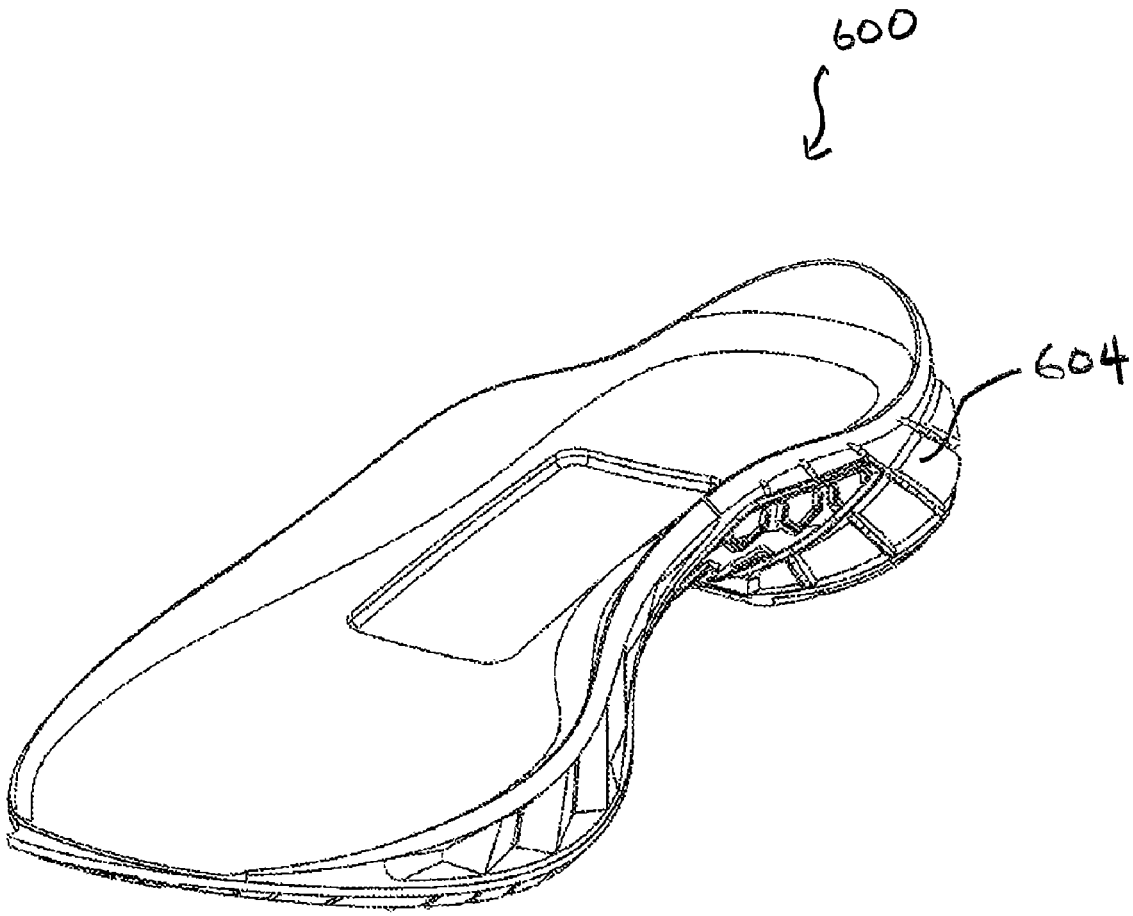
FIG. 9 is a top perspective view of the sole of FIG. 6.

FIG. 8A is a bottom perspective lateral side view of the sole 600 of FIG. 6. FIG. 8B is a bottom perspective medial side view of the sole 600 of FIG. 6. FIG. 9 is a top perspective view of the sole 600 of FIG. 6. As is evident when comparing FIG. 9 to FIG. 4B, sole 600 lacks the polygonal-shaped opening which transect through the entirety of midsole 104. Further, sole 600 lacks the plate 103 incorporated in the previously described embodiments of shoe 100.

Figure 10:
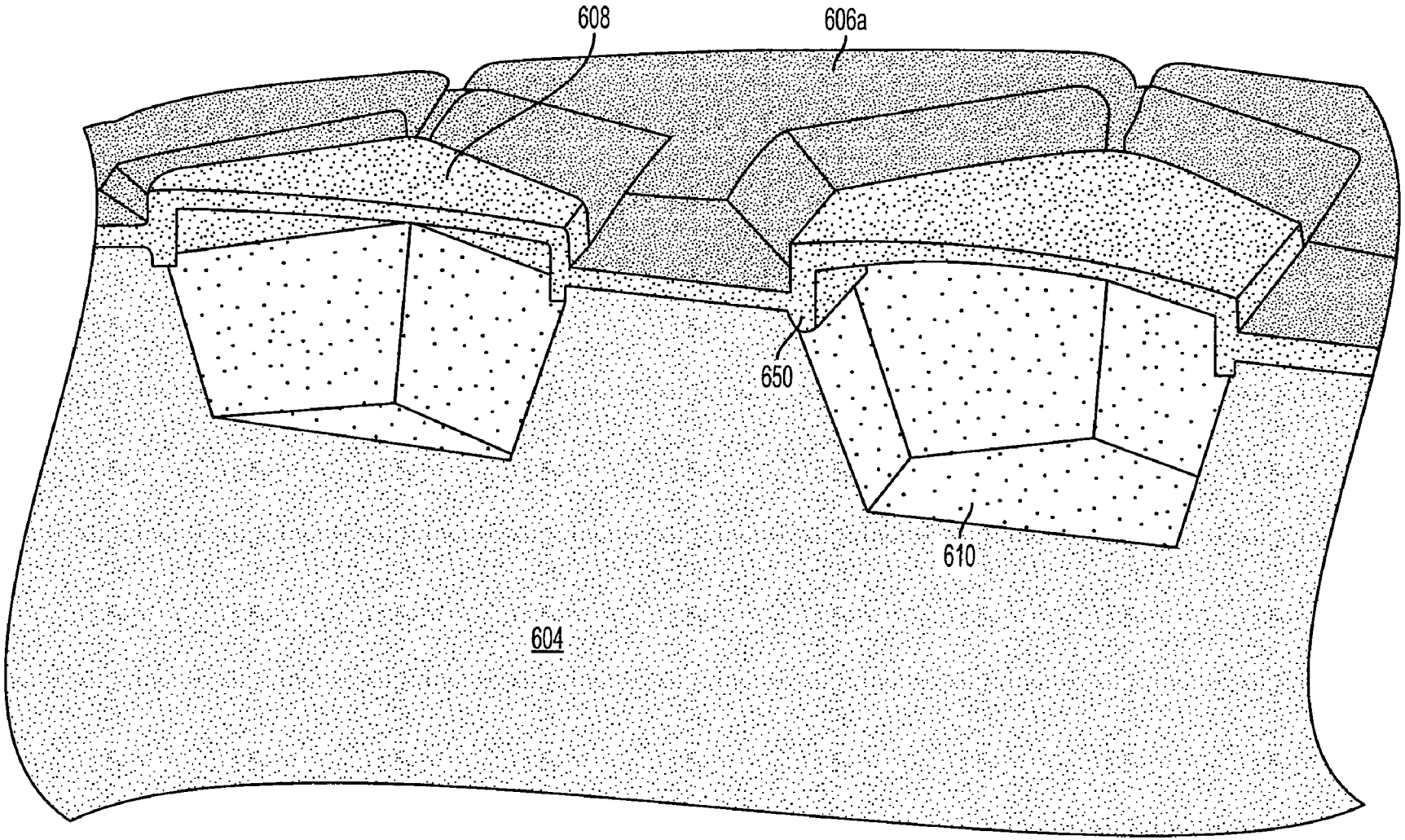
FIG. 10 is an enlarged sectional view of one embodiment of the sole of FIG. 6.

FIG. 10 is an enlarged sectional view of one embodiment of the sole 600 of FIG. 6. As seen in FIG. 10, film 608 may be formed with lip portions 650 to further embed film 608 into openings 610 of midsole 604. Such a lip feature may be applied to any of the films in any of the embodiments described above. Lip portions 650 help to further support midsole 604.

While various embodiments of a shoe have been described, it should be understood that they have been presented by way of example, and not limitation. For example, the design of the upper may vary. Another exemplary alternative embodiment would include a sole having what would traditionally be referred to as a midsole and outsole formed of one integral piece. The sole, in such an embodiment may then have various polygonal-shaped openings, or cavities, which may then be supported by various reinforcement members. For example, plastic wedges may be inserted into the polygonal-shaped openings.

As such, it will be apparent to a person skilled in the relevant art that various changes in form and detail can be made therein without departing from the spirit and scope of the appended claims. Thus the present invention should not be limited by any of the above-described exemplary embodiments, but should be defined only in accordance with the following claims and their equivalents.

What is claimed is:

1. A sole for an article of footwear, comprising:

a midsole having a plurality of polygonal-shaped openings extending therethrough; and a plate disposed adjacent to at least a portion of the midsole, wherein the plate includes at least one polygonal-shaped extension adapted to fit within at least one of said polygonal-shaped openings within said midsole such that an exterior surface of the at least one polygonal-shaped extension contacts at least a portion of a side wall of at least one of said polygonal-shaped openings.

2. The sole of claim 1, further comprising an outsole disposed below the midsole, wherein the outsole includes a plurality of polygonal-shaped openings extending therethrough and aligned with the polygonal-shaped openings of the midsole.

3. The sole of claim 2, further comprising a polyurethane film disposed between the midsole and the outsole.

4. The sole of claim 3, wherein the polyurethane film is transparent.

5. The sole of claim 3, wherein the polyurethane film further includes a lip portion extending partially into at least one of the plurality of polygonal-shaped openings in the midsole.

6. The sole of claim 1, wherein the polygonal-shaped openings are hexagonal.

7. The shoe of claim 1, wherein the plate is formed of a thermoplastic material.

8. A sole for an article of footwear, comprising:

a midsole having a medial side, a lateral side, and a plurality of polygonal-shaped openings extending therethrough;

a medial plate disposed along at least a portion of the medial side of the midsole, wherein the medial plate includes at least one polygonal-shaped extension adapted to fit within at least a portion of at least one of the polygonal-shaped openings in the medial side of the midsole; and a lateral plate disposed along at least a portion of the lateral side of the midsole, wherein the lateral plate includes at least one polygonal-shaped extension adapted to fit within at least a portion of at least one of the polygonal-shaped openings in the lateral side of the midsole.

9. The sole of claim 8, wherein said lateral plate has a softer durometer than said medial plate.

10. The sole of claim 8, further comprising a transparent polyurethane film disposed below the midsole.

11. The sole of claim 10, further comprising an outsole disposed on a bottom surface of the polyurethane film, wherein the outsole includes a plurality of polygonal-shaped openings extending therethrough and aligned with the polygonal-shaped openings of the midsole.

12. The sole of claim 11, wherein the polyurethane film is overmolded on a top surface of the outsole.

13. The sole of claim 8, wherein said polygonal-shaped openings are hexagonal.

14. A sole for an article of footwear, comprising:

a midsole having a plurality of polygonal-shaped cavities formed therein;

a polyurethane film disposed on a bottom surface of the midsole to thereby form a plurality of fluid filled compartments in the midsole; and an outsole disposed below the polyurethane film, wherein the outsole includes a plurality of polygonal-shaped openings extending therethrough and aligned with respective ones of the plurality of polygonal-shaped cavities formed in the midsole.

15. The sole of claim 14, wherein the polyurethane film is transparent.

16. The sole of claim 14, wherein the polygonal-shaped cavities are hexagonal.

17. The sole of claim 14, wherein the polyurethane film further includes a lip portion extending partially into at least one of the plurality of polygonal-shaped cavities formed in the midsole.

18. The sole of claim 14, wherein the polygonal-shaped cavities only a extend partially within the midsole.

19. The sole of claim 14, wherein at least one of the plurality of polygonal-shaped cavities extends at least one-half of the way into the midsole.

20. The sole of claim 14, wherein at least one of the plurality of polygonal-shaped cavities extend at least one-quarter of the way into the midsole.

* * * * *

UNITED STATES PATENT AND TRADEMARK OFFICE

CERTIFICATE OF CORRECTION

PATENT NO. : 7,797,856 B2
APPLICATION NO. : 11/733676
DATED : September 21, 2010
INVENTOR(S) : Andrews et al.

It is certified that error appears in the above-identified patent and that said Letters Patent is hereby corrected as shown below:

Column 8, line 30, reading "cavities only a extend" should read --cavities only extend--.

Signed and Sealed this
Seventeenth Day of May, 2011

David J. Kappos

David J. Kappos
*Director of the United States Patent and Trademark Office*